US010233674B2

(12) United States Patent
Buseman

(10) Patent No.: US 10,233,674 B2
(45) Date of Patent: Mar. 19, 2019

(54) FOLDING LOCK WITH ALARM DEVICE

(71) Applicant: ABUS August Bremicker Söhne KG, Wetter-Volmarstein (DE)

(72) Inventor: Winfried Buseman, Herborn (DE)

(73) Assignee: ABUS August Bremicker Söhne KG, Wetter-Volmarstein (DE)

( * ) Notice: Subject to any disclaimer, the term of this patent is extended or adjusted under 35 U.S.C. 154(b) by 0 days.

(21) Appl. No.: 15/916,468

(22) Filed: Mar. 9, 2018

(65) Prior Publication Data

US 2018/0258668 A1 Sep. 13, 2018

(30) Foreign Application Priority Data

Mar. 9, 2017 (DE) ..... 10 2017 105 031

(51) Int. Cl.

| | |
|---|---|
| ***E05B 71/00*** | (2006.01) |
| ***E05B 45/00*** | (2006.01) |
| ***E05B 67/00*** | (2006.01) |
| *E05B 67/06* | (2006.01) |
| *E05B 15/16* | (2006.01) |
| *F02D 41/00* | (2006.01) |

(Continued)

(52) U.S. Cl.

CPC ..... *E05B 71/00* (2013.01); *E05B 45/005* (2013.01); *E05B 67/003* (2013.01); *E05B 15/1614* (2013.01); *E05B 17/0083* (2013.01); *E05B 67/06* (2013.01); *E05B 73/0005* (2013.01); *E05B 2045/0625* (2013.01); *F02D 2041/001* (2013.01)

(58) Field of Classification Search

CPC ..... E05B 15/1614; E05B 17/0083; E05B 2045/0625; E05B 45/005; E05B 67/003; E05B 67/06; E05B 71/00; E05B 73/0005; F02D 2041/001

USPC ..... 340/542; 70/432–441; 49/13, 14; 109/21, 38; 116/6, 33

See application file for complete search history.

(56) References Cited

U.S. PATENT DOCUMENTS 3,660,997 A * 5/1972 Michnoff ..... E05B 83/24 70/240
3,747,376 A * 7/1973 White, Jr. ..... B62H 5/003 24/573.09

(Continued)

FOREIGN PATENT DOCUMENTS

CN 2209200 Y 10/1995
CN 2576864 Y 10/2003

(Continued)

*Primary Examiner* — Ojiako K Nwugo
(74) *Attorney, Agent, or Firm* — Dinsmore & Shohl LLP

(57) ABSTRACT

A folding lock includes a lock body having a latching mechanism, a jointed bar hoop having a plurality of jointed bars pivotably connected to one another, and a closing bar. A first end of the jointed bar hoop is permanently fastened to the lock body. The closing bar forms a free second end of the jointed bar hoop. The closing bar can be latched to the lock body by the latching mechanism. The lock body includes an alarm device for outputting an alarm signal. The closing bar can selectively be latched to the lock body in a first closing position or in a second closing position, with the alarm device not being able to be activated when the closing bar adopts the first closing position and with the alarm device being able to be activated or being activated when the closing bar adopts the second closing position.

22 Claims, 2 Drawing Sheets

(51) Int. Cl.

| | |
|---|---|
| *E05B 17/00* | (2006.01) |
| *E05B 45/06* | (2006.01) |
| *E05B 73/00* | (2006.01) |

(56) References Cited

U.S. PATENT DOCUMENTS

| | | | | |
|---|---|---|---|---|
| 3,908,414 | A * | 9/1975 | Thorne | B62H 5/003 70/18 |
| 2005/0016231 | A1* | 1/2005 | Stanyer | B60R 25/0221 70/203 |
| 2005/0268675 | A1* | 12/2005 | Loudon | E05B 73/0082 70/58 |
| 2008/0214344 | A1* | 9/2008 | Lodge | G01L 5/047 474/207 |
| 2014/0109631 | A1* | 4/2014 | Asquith | E05B 45/005 70/15 |
| 2014/0360233 | A1* | 12/2014 | Muller | E05B 71/00 70/18 |

FOREIGN PATENT DOCUMENTS

| | | | |
|---|---|---|---|
| CN | 2725465 | Y | 9/2005 |
| CN | 2802011 | Y | 8/2006 |
| DE | 202005013390 | U1 | 2/2007 |
| DE | 102005040066 | A1 | 3/2007 |
| DE | 102013210475 | A1 | 12/2014 |
| WO | 90/12182 | A1 | 10/1990 |
| WO | 99/32348 | A1 | 7/1999 |

* cited by examiner

FOLDING LOCK WITH ALARM DEVICE

CROSS-REFERENCE TO RELATED APPLICATIONS

This application claims priority to German Patent Application No. 102017105031.0 filed Mar. 9, 2017, the entire contents of which are incorporated herein by reference

TECHNICAL FIELD

The present disclosure relates to a folding lock. Such a folding lock comprises a lock body that has a latching mechanism; and a jointed bar hoop that has a plurality of jointed bars pivotably connected to one another; and a closing bar. A first end of the jointed bar hoop is permanently fastened to the lock body. The closing bar forms a free second end of the jointed bar hoop, wherein the closing bar can be latched to the lock body by the latching mechanism.

BACKGROUND

Such a folding lock serves, for example, for the securing of a two-wheeler to a bicycle stand, to a lamppost or the like or for the securing of a two-wheeler against unauthorized riding away. For this purpose, the jointed bars of the jointed bar hoop connected after one another or in a row next to one another are unfolded to form an open loop that, for example, is led around a frame section of the two-wheeler and the bicycle stand, lamppost or the like or is only led through a rim of the two-wheeler. The closing bar is then latched to the lock body in order hereby to close the loop and thus to secure the two-wheeler against unauthorized removal or unauthorized riding away.

The jointed bars and the closing bar can typically be folded together to form a compact arrangement—the so-called yardstick configuration—for the transport of the folding lock by the authorized user. The jointed bars and the closing bar are pivoted in the manner of a foldable yardstick for this purpose and are hereby brought into parallel alignment with one another.

Such a folding lock is known from document DE102005040066A1, wherein the latching mechanism of this folding lock has a lock cylinder with a compulsory guidance of the latch. A folding lock having an automatic function is known from DE102013210475A1 in which the closing bar (and thus the second end of the jointed bar hoop) can be automatically latched to the lock body by the latching mechanism by introducing the closing bar into a receiving opening of the lock body.

When not in use, a folding lock of the named kind can be stored and transported in a storage device (e.g. a bag, a sleeve or a holder) such as is known from DE202005013390U1. The jointed bar hoop is folded together into said compact yardstick configuration for this purpose.

In the event of a manipulation attempt at a folding lock of the named kind to steal a two-wheeler thereby secured, the time required for the unauthorized opening of the folding lock is an important aspect. The less time available to a thief, the more difficult a successful manipulation attempt becomes.

It is therefore conceivable to equip the folding lock with an alarm device that emits an acoustic and/or optical alarm signal as soon as a manipulation attempt is detected. In practice, however, a comfortable operation of such an alarm device by the authorized user is difficult, in particular as regards the arming of the alarm device (called the "activation" of the alarm device in the following). An alarm device that is, for example, sensitive to vibration may not trigger during the transport of the folding lock and an activation of the alarm device is also not desired on every locking up of the two-wheeler (e.g. securing the two-wheeler to a bike rack of a motor vehicle).

It is therefore an object of the present disclosure to provide a folding lock that offers increased security with respect to manipulation attempts with a comfortable operation.

SUMMARY

This object is satisfied by a folding lock having a lock body that furthermore comprises an alarm device for emitting an alarm signal, wherein the closing bar is selectively latchable to the lock body in a first closing position or in a second closing position, wherein the alarm device cannot be activated when the closing bar adopts the first closing position, and wherein the alarm device can be activated or is activated when the closing bar adopts the second closing position.

With the folding lock in accordance with the present disclosure, the closing bar can selectively be latched to the lock body in one of two different closing positions. The folding lock furthermore comprises an alarm device that outputs an alarm signal, for example an acoustic alarm signal, in the event of a detected manipulation attempt. With respect to the activation or arming of the alarm device, a first closing position of the closing bar forms a disarmed closing position and a second closing position of the locking bar forms an armed closing position. In the first closing position, the closing bar can admittedly be latched to the lock body to secure the two-wheeler against an unauthorized removal or an unauthorized riding away; however, the alarm device cannot be simultaneously activated time in the first closing position, in particular also not in an accidental manner. In the second closing position, in contrast, the closing bar can be latched to the lock body and the alarm device can additionally be activated (or this takes place automatically as will be explained in the following). The authorized user can thus determine whether the alarm device should be able to be activated or should be activated or not by selecting the closing position of the closing bar. A comfortable and in particular also failsafe operation of the folding lock hereby results.

The folding lock in accordance with the present disclosure increases the security against manipulation attempts in that an alarm device is provided in addition to a latching function. The activation of the alarm device can take place directly or indirectly via the closing bar. The two named closing positions can be selected in a simple manner, for example, by a simple displacement of the closing bar during the securing process of the two-wheeler. The equipping of the folding lock with an alarm device contributes to the security against possible manipulation attempts. The time for a manipulation attempt is effectively shortened by the acoustic and/or optical alarm signal since a thief has to anticipate the speedy return of the user or the intervention of passers-by or of law enforcement officers whose attention was drawn to the attempted manipulation attempt by the alarm signal. As already mentioned above, the time factor is decisive to prevent a successful theft or at least to make it a lot more difficult. It has furthermore been found that just the knowledge of the presence of an alarm device produces a deterrent effect on possible thieves. In addition, due to the two-stage activation of the alarm device that is comfortable to handle, situations are taken into account in which the triggering of an alarm signal is not desired, but in which the two-wheeler should nevertheless be comprehensively secured, such as during a transport on a motor vehicle bike rack.

Advantageous embodiments of the present disclosure can be seen from the description and from the drawing.

In accordance with an embodiment, the alarm device can be activated in that the closing bar is brought into the second closing position. The alarm device can thus be armed automatically in a particularly simple and comfortable manner for the user, with only one detector being required to detect the second closing position.

Alternatively to this, the alarm device can be able to be activated in that the closing bar is brought into the second closing position and in that furthermore the latching mechanism is brought into a latching position in which the latching mechanism latches the closing bar to the lock body. In this embodiment, it is therefore necessary for an activation of the alarm device that the closing bar adopts the second closing position and that, in addition, the closing bar is latched to the lock body in the second closing position. A detection of whether the closing bar has adopted the second closing position can take place, for example, by an associated first detector. A detection of whether the latching mechanism has adopted the latching position can take place by a second detector; for example, an actuation element that actuates a contact switch in the latching position can be provided at a moving element of the latching mechanism (e.g. a latch element or an engager). The signals of the two detectors can be supplied to a logical AND conjunction to activate the alarm device when the second closing position of the closing bar and the latching position of the latching mechanism are detected. In this embodiment, the waiting interval can be cut that has to elapse up to the start of a monitoring operation of the alarm device so that the authorized user can properly end the latching procedure.

In accordance with a further alternative, it is also possible that the alarm device can be activated in that the closing bar is brought into the second closing position and in that furthermore an additional switching device is actuated. A detection of whether the closing bar has adopted the second closing position can in turn take place by an associated detector (e.g. a contact switch). Said additional switching device can be a switching device that is operable from the outside, in particular a switch arranged at the lock body and operable from the outside (e.g. a sliding switch, a rocker switch, a press button, etc.). Said additional switching device can, however, also comprise a switching device that is wirelessly operable from the outside, that has a radio reception unit, for example, and that is controlled by a separate remote control radio unit associated with the folding lock or by a cell phone (e.g. via Bluetooth, NFC, wireless LAN). The signals of the closing position detector and of the additional switching device can also be supplied to a logical AND conjunction in this embodiment to activate the alarm device as necessary.

In accordance with an embodiment, the signal of the detector that detects the second closing position of the closing bar can serve to directly activate the alarm device. Or the signal of the detector is first evaluated and/or logically connected by an evaluation and control circuit of the alarm device.

As regards said detector for detecting the second closing position of the closing bar, it can be configured, for example, for a contactless detection of the closing bar, e.g. in the form of a Hall sensor or of a Reed switch.

In accordance with an advantageously simple embodiment, the lock body can have a switch that is actuated directly or indirectly by the closing bar when the closing bar is brought into the second closing position. This can be done, for example, via a contact switch that enables a direct (mechanical) actuation of the switch by the closing bar. The switch can in particular be actuatable by the tip of the closing bar.

In accordance with an embodiment, the lock body can have an introduction passage for an introduction of the closing bar into the lock body, wherein said switch is arranged outside the introduction passage in the lock body and outside an axial prolongation of the introduction passage, and wherein the lock body has a transmission element via which the switch is indirectly actuatable by the closing bar. The switch for detecting the second closing position of the closing bar can thus be arranged remote from the introduction passage for the closing bar and in particular outside the alignment of the introduction passage for the closing. The switch is hereby protected from contamination that could move into the interior of the lock body via the introduction passage. The switch is furthermore hereby protected from damage or manipulation from the outside. Said transmission element, for example a pivotable element and/or an element movable in translation, provides a transmission of an actuation by the closing bar to the switch. The transmission element can be preloaded in the direction of an OFF position of the switch, for example by a compression spring.

The second closing position of the closing bar is advantageously disposed deeper in the lock body than the first closing position with respect to a direction of introduction of the closing bar into the lock body. In other words, in this embodiment, the closing bar is first brought into the first closing position that can also be called a disarmed closing position. Only when the closing bar is moved beyond the first closing position can the closing bar reach the second closing position that can also be called an armed closing position. The user hereby has the two-stage operation of the closing bar for the selection of the desired state of the alarm device made particularly clear to him.

It is, however, also possible in accordance with an alternative embodiment that this order of the first closing position and of the second closing position is swapped over with respect to the direction of introduction. In accordance with a further alternative embodiment, it is also possible that two different receiving openings are provided for the introduction of the closing bar into the lock body, for example disposed next to one another or at mutually oppositely disposed sides of the lock body, with the closing bar adopting the first closing position when the closing bar has been introduced into the lock body through the one receiving opening and with the closing bar adopting the second closing position when the closing bar has been introduced into the lock body through the other receiving opening.

In accordance with an embodiment, the alarm device comprises at least one of the following components, in some embodiments, the alarm device comprises a plurality of the following components, and in some other embodiments, the alarm device comprises all of the following components:

- an electrical energy source configured to supply energy to the alarm device;
- an accelerometer;
- an evaluation and control circuit;

an signal generator such as an acoustic and/or optical signal generator; and/or a radio transmission unit configured to wirelessly transmit the alarm signal.

The energy source here can comprise one or more commercial batteries and/or an electrical rechargeable battery. If a rechargeable battery is provided, the folding lock at the lock body can furthermore have a power supply connector to be able to charge the battery.

As regards the accelerometer, it can be configured as a static accelerometer or as a dynamic accelerometer, with the static accelerometer being able to be configured as a tilt sensor for recognizing an orientation and/or a change of position and with the dynamic accelerometer being able to be used for recognizing a vibration.

The evaluation and control circuit can, for example, evaluate the signal of said detector for detecting the second closing position of the closing bar and, where applicable, the respective signal of further detectors or switches. The evaluation and control circuit can furthermore also evaluate the signal of said accelerometer in order in particular to trigger the output of an alarm signal on a detection of a change of position or of a vibration during monitoring operation.

The acoustic and/or optical signal generator can, for example, comprise a loudspeaker, in particular a piezo loudspeaker and/or a light emitting diode.

Alternatively or additionally to the output of an acoustic or optical alarm signal, the folding lock can have a radio transmission unit for a wireless transmission of an alarm signal, in particular to a radio reception unit of the authorized user. Such a radio reception unit can be a separate device associated with the folding lock (for example the already named radio control unit) or a cell phone. The signal transmission can take place in accordance with a common standard (e.g. Bluetooth, wireless LAN, GSM).

In accordance with an embodiment, the lock body has a housing having a storage chamber for the alarm device, with the storage chamber having an alarm device installation opening and with the closing bar at least partly blocking the alarm device installation opening when the closing bar adopts the second closing position. At least one component of the alarm device or the total alarm device can be inserted into the storage compartment through the alarm device installation opening, for example on the manufacture of the folding lock or for the replacement of the battery or batteries. Since the closing bar is typically produced from a particularly robust material, the closing bar can thus be used in a particularly simple manner in the second closing position, that is when the alarm device can be activated or is activated, to protect the alarm device in the storage chamber from manipulation from the outside.

In this embodiment, the lock body can furthermore have a securing element that is movable into a securing position by the closing bar when the closing bar is introduced into the second closing position, with the securing element at least partly blocking the alarm device installation opening in the securing position. In other words, the securing element can be used in addition to the closing bar to protect the alarm device in the storage chamber from a manipulation from the outside. The securing element can, for example, engage partly into an opening (e.g. a recess) of a housing of the lock body for this purpose and can partly cover the alarm device installation opening. The securing element can, for example, be formed by a securing pin or by a securing plate. The securing element can in particular be moved into the securing position by the tip of the closing bar.

In accordance with a further embodiment, the lock body can have a sound exit opening at least two different sides that communicates with the acoustic signal generator of the alarm device via a respective sound transmission channel. It can be prevented, or at least made more difficult, by a plurality of sound exit openings at two or more sides of the lock body, for example two, three, or four sound exit openings, that the output of the acoustic signal is suppressed in the event of a detected manipulation attempt by holding a single sound exit opening closed.

It is useful in this embodiment if the acoustic signal generator is arranged outside the alignment of the respective sound transmission channel. In other words, the acoustic signal generator is not located in the prolongation of the respective sound transmission channel in this embodiment, but is rather offset laterally therefrom so that the acoustic signal generator is not easily reachable from the outside and could be damaged, for instance by introducing a sharp tool through the respective sound exit opening.

In accordance with an embodiment, the evaluation and control circuit is configured first to allow a waiting interval and then a calibration interval to elapse for the activation of the alarm device before the evaluation and control circuit transitions into monitoring operation. The evaluation and control circuit is furthermore configured to detect a position of the folding lock by the accelerometer during the calibration interval and to store said position, with the evaluation and control circuit further being configured to compare a current position of the folding lock detected by the accelerometer with the stored position several times during monitoring operation and to trigger an alarm signal when the comparison shows a predefined minimum deviation. The waiting interval allows the authorized user to end the latching procedure without triggering an alarm signal.

In this respect, a waiting signal may also be taken into account for the triggering of the alarm signal so that sufficient time remains for the authorized user to grasp and to unlatch the lock to hereby deactivate the alarm device. Alternatively to this, only an acoustic and/or optical pre-alarm signal can first be output before the alarm signal is triggered after the elapse of the waiting interval.

For the activation of the alarm device, the evaluation and control circuit can also check whether the closing bar has adopted the second closing position for a predefined minimum period. It can hereby be prevented that an unintentional brief bringing of the closing bar into the second closing position already accidentally results in an activation of the alarm device.

The evaluation and control circuit is advantageously configured to deactivate the alarm device when the closing bar leaves the second closing position. This requires that the closing bar has first been unlatched, i.e. the latching mechanism must be in an unlatched position. The leaving of the second closing position can be detected by the same detector that also detects the adopting of the second closing position for the activation of the alarm device.

In accordance with an embodiment, the lock body comprises a common housing for the latching mechanism and the alarm device, with the common housing having a first chamber for the latching mechanism and a second chamber, separate from the first, for the alarm device. This separation makes possible manipulation attempts more difficult and thus increases the security of the alarm device. The second chamber can in particular be the already named storage chamber for the alarm device.

In this embodiment, the common housing can be formed by a single casting, for example of hardened cast steel.

It is furthermore of advantage for the second chamber for the alarm device to be arranged at the side of the first chamber remote from the jointed bar hoop. The first chamber having the latching mechanism located therein is hereby protected in the lateral direction by the jointed bar hoop, on the one hand, and by the second chamber, on the other hand.

It is additionally useful for the first chamber (for the latching mechanism) to be closed with the exception of a latching mechanism installation opening, a key introduction opening (for introducing a key), an optional inlet opening for introducing the closing bar (if a separate opening is provided for this purpose), an optional passage opening for passing the closing bar into the second chamber (if a separate opening is provided for this purpose), and optional fixing openings for inserting fixing elements (e.g. fixing pins) for fixing the latching mechanism. An at least substantially closed separating wall can in particular be provided between the first chamber (for the latching mechanism) and the second chamber (for the alarm device). The latching mechanism can be inserted into the first chamber through the latching mechanism installation opening on the manufacture of the folding lock. In this embodiment, the closing bar can at least partly block the latching mechanism installation opening when the closing bar adopts the first closing position or the second closing position. Since the closing bar is typically produced from a particularly robust material, the closing bar can thus be used in a particularly simple manner to protect the latching mechanism in the first chamber from a manipulation from the outside while the closing bar is latched to the lock body.

In some embodiments, the lock body has a latch device that is configured to hold the closing bar in a force fit in the first closing position and/or in the second closing position.

The latch device can, for example, have an elevated portion and a recess that are provided at a section of the lock body and at the closing bar and cooperate in an elastically engaging manner. The latch device can in particular comprise an elastic section of a housing or of a housing sleeve of the lock body that latchingly cooperates with a counter-section of the closing bar. The housing sleeve can consist of silicone, for example.

In accordance with an embodiment, the jointed bar hoop can be folded into a yardstick configuration in which the jointed bars and the closing bar extend in parallel with one another. This enables a space-saving transport of the folding lock. In some embodiments, the jointed bar hoop can be brought into the yardstick configuration when the closing bar adopts the first closing position. Alternatively or additionally to this, the jointed bar hoop can be brought into the yardstick configuration when the closing bar adopts an unlatched transport position (i.e. when the closing bar is not latched to the lock body). In some other embodiments, the jointed bar hoop cannot, however, be brought into the yardstick configuration when the closing bar adopts the second closing position. It is hereby prevented in a particularly simple and effective manner that the user has transported the folding lock in the folded state (for example in the initially named bag, sleeve, or holder) and in so doing has accidentally activated the alarm device, which would result in an unwanted output of an alarm signal due to the changes of position and to vibrations during the transport or during travel with the two-wheeler. An operating error in this respect is therefore prevented in that, on the one hand, the alarm device can only be activated in the second closing position of the closing bar and in that, on the other hand, the jointed bar hoop cannot be brought into the yardstick configuration in this second closing position, said yardstick configuration being a requirement for the storage in a conventional bag, however.

To enable a compact arrangement of the folding lock, the longitudinal axes of the jointed bars and of the closing bar can extend in parallel with one another in a plane in the yardstick configuration of the jointed bar hoop. The lock body can furthermore extend along a longitudinal axis, with the longitudinal axis of the lock body extending within a plane that is spanned in the yardstick configuration of the jointed bar hoop by the longitudinal axes of the jointed bars and of the closing bar. Furthermore, the lock body can arranged within a plane of extent of the jointed bar hoop in the yardstick configuration of the jointed bar hoop so that the lock body and the jointed bar hoop together form a flat packet.

In an advantageous embodiment, the lock body has at least one receiving opening into which the closing bar projects in the first closing position and in the second closing position. In some embodiments, the closing bar can be introduced into the receiving opening of the lock body axially with respect to its longitudinal axis, with a boundary of the receiving opening peripherally surrounding the closing bar.

It is useful for the latching of the closing bar to the lock body for the closing bar of the jointed bar hope to have a latching section and for the latching mechanism of the lock body to have a latch that - when the closing bar adopts the first closing position or the second closing position - can be brought into engagement with the latching section of the closing bar to latch the closing bar to the lock body. The latching section can here be configured as a recess (in particular as a blind hole), as a passage hole, or as a lateral cut-out.

The latching mechanism can furthermore have a lock cylinder and an engager that can be driven by a rotational actuation of the lock cylinder to make a rotational movement to effect a latching movement and/or an unlatching movement of the latch.

In this embodiment, the latching mechanism can in particular also have a conversion device that converts a rotational movement of the engager of the lock cylinder into a linear movement of the latch, with the conversion device, for example, being able to have a sloping surface at the engager and a sloping surface at the latch that can cooperate with one another.

In accordance with an embodiment, the latch can be moved via a compulsory guidance in both directions (latching and unlatching) by a corresponding actuation of the lock cylinder. Alternatively to this, an automatic function can be provided, with the closing bar being automatically latchable to the lock body in the first closing position and/or in the second closing position by introduction into the receiving opening of the lock body. In some embodiments, the latching mechanism comprises a preload device that preloads the latch in the latching position, with the latch being temporarily movable against the preload from the latching position into an unlatched position by an incomplete introduction of the closing bar into the receiving opening of the lock body, and with the preload device being adapted to move the latch back into the latched position again when the closing bar has been introduced into the receiving opening up to the first closing position and/or up to the second closing position.

In accordance with a modification, the present disclosure further relates to a folding lock having a lock body that has a latching mechanism; and having a jointed bar hoop that has a plurality of jointed bars pivotably connected to one another; and having a closing bar, with a first end of the jointed bar hoop being permanently fastened to the lock body and with the closing bar forming a free second end of the jointed bar hoop, with the closing bar being latchable to the lock body by the latching mechanism, with the lock body furthermore comprising an alarm device for outputting an alarm signal, and with the alarm device being able to be activated by the closing bar when the closing bar adopts a closing position in which the closing bar is latched to the lock body.

As explained above, a detector for detecting the closing position of the closing bar can be provided for this purpose. The lock body can in particular have a switch (e.g. a contact switch) that is actuatable by the closing bar when the closing bar is brought into the closing position. The switch can be directly actuated by the closing bar (in particular by the tip of the closing bar); or the switch can be indirectly actuated via a transmission element. An evaluation and control circuit can evaluate the signal of the detector or switch. The further above-explained embodiments and features can be implemented in an analog manner in this modification.

BRIEF DESCRIPTION OF THE DRAWINGS

Embodiments of the present disclosure will be explained only by way of example in the following with reference to the drawings. Identical or similar elements therein are marked by the same reference numerals.

DETAILED DESCRIPTION

Figure 1:
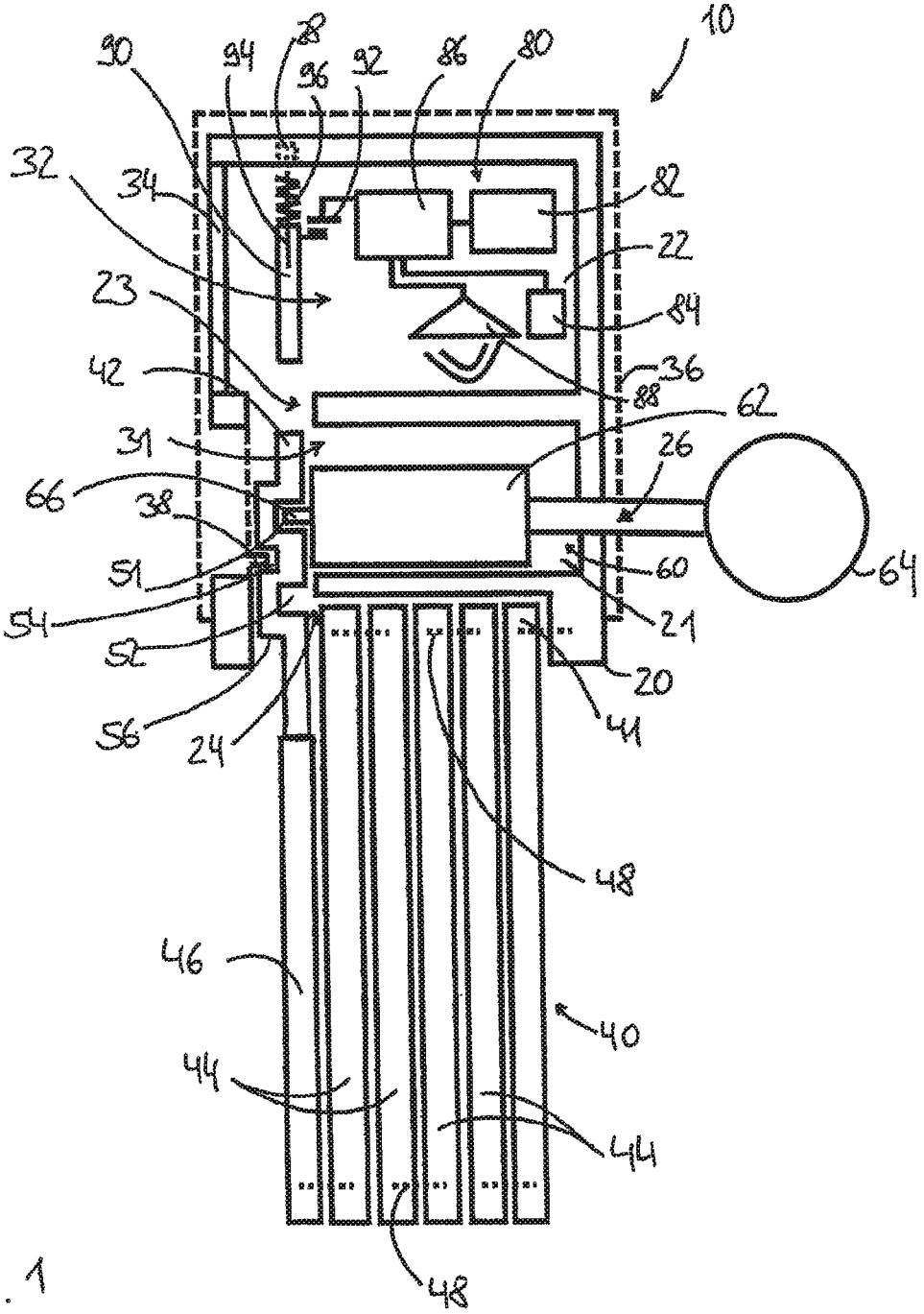
FIG. 1 shows in a schematic representation a folding lock in a first closing position of the closing bar.

The folding lock shown in FIG. 1 comprises a lock body 10 as well as a jointed bar hoop 40. The lock body 10 has a housing 20. The housing 20 forms a first chamber 21 for a latching mechanism 60 and a second chamber 22 separate therefrom for an alarm device 80. The first chamber 21 is accessible via a latching mechanism installation opening 31 and the second chamber 22 is accessible via an alarm device installation opening 32. A passage opening 23 is provided between the first chamber 21 and the second chamber 22. The alarm device installation opening 32 is closed by a chamber cover 34, with the chamber cover 34, however, also being able to be part of a removal inner housing (not shown) that fixes the different components of the alarm device 80 relative to one another. The housing 20 furthermore has a receiving opening 24, a key introduction opening 26, and a support recess 28. The housing 20 is regionally provided with an elastic housing sleeve 36 that covers the latching mechanism installation opening 31 and has a latch nose 38 there that faces in the direction of the latching mechanism 60.

The jointed bar hoop 40 has a first end 41 that is permanently fastened to the lock body 10 and has a free second end 42 that can selectively be latched to the lock body 10. The jointed bar hoop 40 adopts a so-called yardstick configuration in the state shown in FIG. 1. In the unlocked state of the folding lock, the jointed bar hoop 40 can be unfolded out of the shown yardstick configuration to form an open loop that can be placed around parts of a two-wheeler or around another article. The free second end 42 of the jointed bar hoop 40 can then be introduced into the receiving opening 24 of the housing 20 and can be latched to the lock body 10 therein by the latching mechanism 60. The formed loop is hereby closed and the two-wheeler is blocked or is secured at the respective article (e.g. a bicycle stand).

The jointed bar hoop 40 comprises a plurality of jointed bars 44 and (at the free second end 42) a closing bar 46. The jointed bars 44 and the closing bar 46 are each formed as flat. The jointed bars 44 and the closing bar 46 are connected to one another in an articulated manner in a row such that their joint axes 48 extend in parallel or coaxially with one another. The jointed bar hoop 40 can hereby be folded together into a so-called yardstick configuration to form a compact unit in which the jointed bars 44 and the closing bar 46 extend in parallel with one another in a plane. The closing bar 46 has a first latching recess 51 and a second latching recess 52 close to its tip at the side facing the latching mechanism 60. The closing bar 46 has a latch recess 54 between the first latching recess 51 and the second latching recess 52, and indeed at the side remote from the latching mechanism 60. The closing bar 46 also has a latch step 56 there beside.

The latching mechanism 60 located in the first chamber 21 of the housing 20 comprises a lock cylinder 62 which is accessible via the key introduction opening 26 and into which a key 64 can be introduced to actuate the lock cylinder 62 by rotating the cylinder core and hereby to move a latch 66 coupled to the lock cylinder 62 in a straight line between a latching position and an unlatched position.

The alarm device 80 located in the second chamber 22 of the housing 20 comprises an electrical energy source 82 in the form of a battery for the energy supply, an accelerometer 84, an evaluation and control circuit 86, and an acoustic signal generator 88 in the form of a piezo loudspeaker. The alarm device 80 furthermore comprise a switch 92 that can be actuated via a transmission element 90 and that is connected in a technical signal manner to the evaluation and control circuit 86. The switch 92 is formed in the embodiment shown here by a contact switch responding to mechanical contact. A securing element 94 and a compression spring 96 for preloading the transmission element 90 are furthermore associated with the transmission element 90.

In the state shown in FIG. 1, the folding lock is latched, with the closing bar 46 being only partly introduced into the receiving opening 24 of the housing 20. In this position, the closing bar 46 is located in a first closing position (disarmed closing position). The lock cylinder 62 can be rotationally actuated by the key 64 introduced through the key introduction opening 26 to bring the latch 66 into the latching position shown in FIG. 1 in which the latch 66 engages into the first latching recess 51 of the closing bar 46, in which latching position the latch 66 engages into the first latching recess 51 of the closing bar 46 and hereby latches the closing bar 46 to the lock body 10. The latch 66 can be moved back into an unlatched position in which the latch 66 releases the closing bar 46 for a removal from the receiving opening 24 of the housing 20 by a rotational actuation of the lock cylinder 62 in the opposite direction. In the first closing position of the closing bar 46, the closing bar 46 covers the latching mechanism installation opening 31.

So that the user can easily feel the first closing position of the closing bar 46 on the introduction of the closing bar 46 into the receiving opening 24, the latch nose 38 of the elastic housing sleeve 36 is arranged such that the latch nose 38 latches into the latch recess 54 of the closing bar 46 as soon as the closing bar 46 has adopted the first closing position. In the unlatched state, the closing bar 46 is held in the first closing position by the latch connection between the latch nose 38 and the latch recess 54, which facilitates the handling on the latching and unlatching.

The first closing position of the closing bar 46 in accordance with FIG. 1 simultaneously forms a transport position of the jointed bar hoop 40 for a transport of the folding lock. In the transport position, the folding lock can be comfortably stored and taken along in a storage device (e.g. a bag, a sleeve, or a holder) that peripherally engages around the folded jointed bar hoop 40 in a compact manner in the yardstick configuration.

In the first closing position of the closing bar 46 shown in FIG. 1, the alarm device 80 cannot be activated. This is only possible in a second closing position of the closing bar 46 and can in particular take place automatically in the embodiment shown, as will be explained with reference to FIG. 2 in the following.

Figure 2:
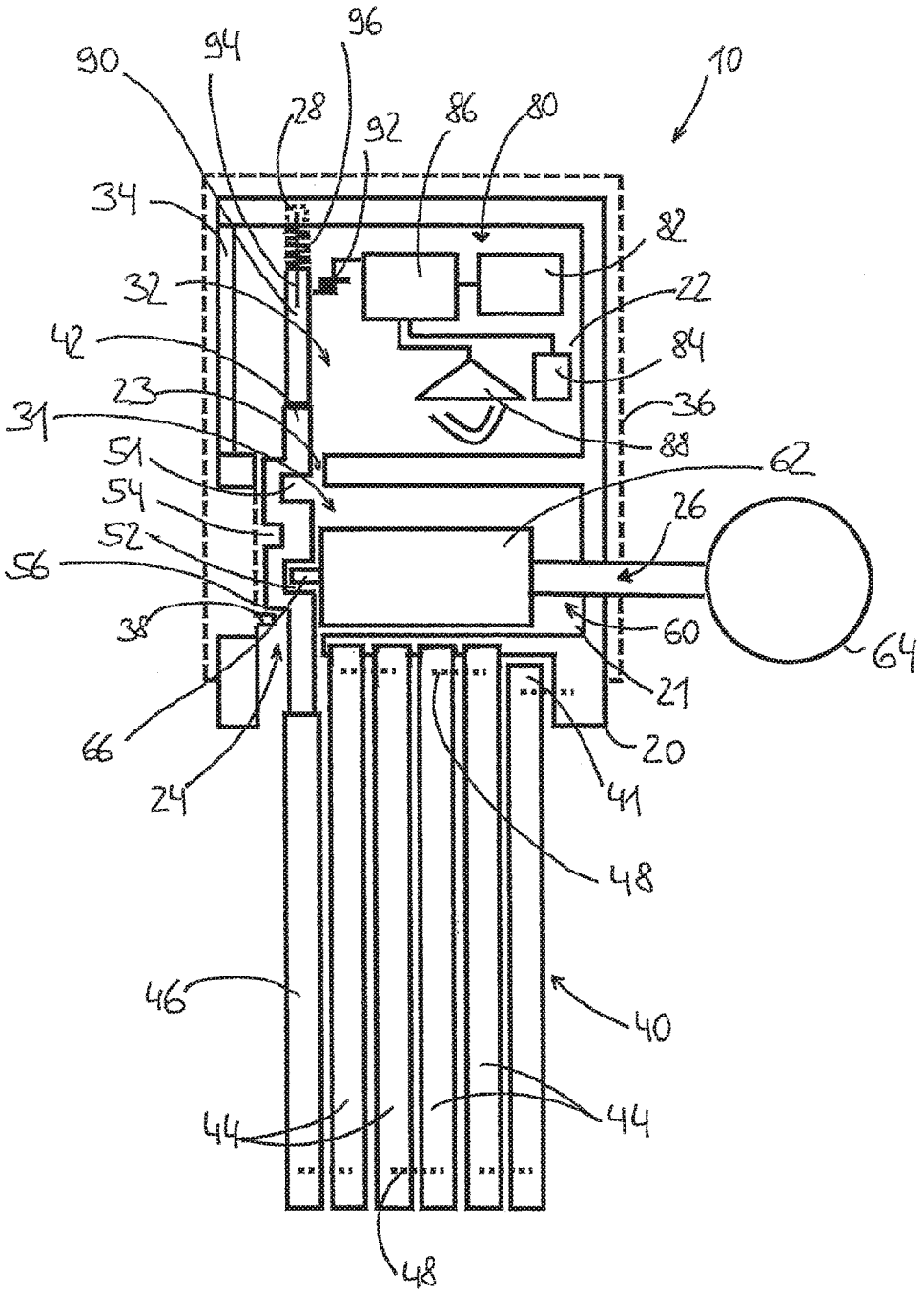
FIG. 2 shows in a schematic representation a folding lock in a second closing position of the closing bar.

FIG. 2 shows in a representation corresponding to FIG. 1 the folding lock in a state in which the closing bar 46 has been completely introduced into the receiving opening 24 of the lock body 10. In this position, the closing bar 46 is in the second closing position (armed closing position), with the tip of the closing bar 46 being guided through the passage opening 23 between the first chamber 21 and the second chamber 22 of the housing 20 and thus projecting into the second chamber 22. This complete introduction movement of the closing bar 46 into the receiving opening 24 is, however, only possible when the jointed bar hoop 40 departs from the yardstick configuration in accordance with FIG. 1. This can be seen in FIG. 2 in that the four center jointed bars 44 lie on the lock body 10 in a sloped alignment, i.e. the four center jointed bars 44 are pivoted out of the plane of the paper with respect to the representation in accordance with FIG. 2. The latching of the folding lock in the second closing body takes place in an analog manner to the first closing position, with the latch 66 being brought into the latching position by actuating the lock cylinder 62, in which latching position the latch 66 engages into the second latching recess 52 of the closing bar 46 and hereby latches the closing bar 46 to the lock body 10.

In the second closing position of the closing bar 46, the alarm device 80 is activated by the closing bar 46, which permits an automatic arming of the alarm device 80 in a simple manner. To detect the second closing position of the closing bar 46, the reading and control circuit 86 is connected to the switch 92 that is indirectly actuated via the transmission element 90 by the tip of the closing bar 46 as soon as the closing bar 46 has been brought into the second closing position. The switch 92 can be arranged outside the alignment of the receiving opening 24 of the lock body 10 by the interposition of the transmission element 90 that is, for example, configured as a rectilinearly movable, laterally projecting actuation arm, whereby the switch 92 can be better protected against contamination, damage, or manipulation.

The securing element 94, that is in pin form in the embodiment shown here and that is surrounded by the compression spring 96, is connected to the movable transmission element 90. In the second closing position of the closing bar 46, the securing element 94 together with the transmission element 90 is moved against the preload of the compression spring 96 into a securing position in which the securing element 94 engages into the support recess 28 of the housing 20. In the second closing position of the closing bar 46 in accordance with FIG. 2, the closing bar 46 and the securing element 94 each partly block the alarm device installation opening 32 of the housing 20 to protect the alarm device 80 against manipulation from the outside, with the securing element 94 being supported in the support recess 28 of the housing 20.

In the second closing position of the closing bar 46 in accordance with FIG. 2, the latch nose 38 of the elastic housing sleeve 36 engages behind the latch step 56 of the closing bar 46 so that a latch connection is in turn formed that also provides a security against an unintentional slipping out of the closing bar 46 in the unlatched state.

Once the folding lock has been brought into the second closing position and the switch 92 has been actuated by the closing bar 46 via the transmission element 90, the evaluation and control circuit 86 first allows a waiting interval and then a calibration interval to elapse before it transitions into monitoring operation. In this respect, the position of the folding lock (orientation relevant to gravity) is detected and stored during the calibration interval by the tilt-sensitive and vibration-sensitive accelerometer 84. In the subsequent monitoring operation, the evaluation and control circuit 86 thereupon repeatedly compares a current position of the folding lock respectively detected by the accelerometer 84 with the stored position and triggers an alarm signal when the comparison exceeds a predefined minimum deviation. Due to the waiting interval, it is made possible for the user to end the latching procedure without triggering an alarm signal.

The acoustic alarm signal generated in the case of an alarm event by the acoustic signal generator 88 is conducted between the first chamber 21 and the second chamber 22 of the housing 20 and can exit the housing 20 via a plurality of sound exit openings (not shown) at different sides of the housing 20. Since the acoustic signal generator 88 is hidden in the interior of the lock body 10 by this construction, it can itself not be manipulated, which further increases the security of the alarm device 80.

The output of such an alarm signal can only be stopped by the authorized user. It is necessary for this purpose to first unlock the closing bar 46 by actuating the lock cylinder 62 by the key 64 and thereupon to pull the closing bar 46 a little out of the lock body 10, whereby the transmission element 90 preloaded by the compression spring 96 loses contact with the switch 92 (OFF position of the switch 92) and the read-out and control circuit 86 suppresses the output of the alarm signal. The alarm device 80 can accordingly only be deactivated in the unlatched state of the lock cylinder 62. In this state, the jointed bar hoop 40 can be brought back into the yardstick configuration for the transport and the closing bar 46 can be latched in the first closed position for the transport.

The invention claimed is:

1. A folding lock comprising:

a lock body that has a latching mechanism;

a jointed bar hoop that has a plurality of jointed bars pivotably connected to one another; and a closing bar, wherein a first end of the jointed bar hoop is permanently fastened to the lock body and the closing bar forms a free second end of the jointed bar hoop, with the closing bar being latchable to the lock body by the latching mechanism, wherein the lock body includes an alarm device for outputting an alarm signal, with the closing bar being selectively latchable to the lock body in a first closing position or in a second closing position, with the alarm device not being able to be activated when the closing bar adopts the first closing position, and with the alarm device being able to be activated or being activated when the closing bar adopts the second closing position.

2. The folding lock in accordance with claim 1,
wherein the alarm device can be activated in that the closing bar is brought into the second closing position; or in that the closing bar is brought into the second closing position and the latching mechanism is brought into a latching position.

3. The folding lock in accordance with claim 1,
wherein the lock body has a switch that is actuatable by bringing the closing bar into the second closing position.

4. The folding lock in accordance with claim 3,
wherein the lock body has an introduction passage for an introduction of the closing bar into the lock body, wherein said switch is arranged in the lock body outside the introduction passage and outside an axial prolongation of the introduction passage, and wherein the lock body has a transmission element via which the switch is indirectly actuatable by the closing bar.

5. The folding lock in accordance with claim 1,
wherein the second closing position of the closing bar is disposed deeper in the lock body than the first closing position with respect to an introduction direction of the closing bar into the lock body.

6. The folding lock in accordance with claim 1,
wherein the alarm device has at least one of the following:
an electrical energy source configured to supply energy to the alarm device;
an accelerometer;
an evaluation and control circuit;
a signal generator; or
a radio transmission unit configured to wirelessly transmit the alarm signal.

7. The folding lock in accordance with claim 6,
wherein the lock body has a housing having a storage chamber for the alarm device, with the storage chamber having an alarm device installation opening through which at least one component of the alarm device can be inserted into the storage chamber, and with the closing bar at least partly blocking the alarm device installation opening when the closing bar adopts the second closing position.

8. The folding lock in accordance with claim 7,
wherein the lock body has a securing element that is movable into a securing position when the closing bar is brought into the second closing position, with the securing element at least partly blocking the alarm device installation opening in the securing position.

9. The folding lock in accordance with claim 6,
wherein the signal generator is an acoustic signal generator, and
wherein the lock body has a sound exit opening at least two different sides that communicates with the acoustic signal generator via a respective sound transmission channel.

10. The folding lock in accordance with claim 9,
wherein the acoustic signal generator is arranged outside an alignment of the respective sound transmission channel.

11. The folding lock in accordance with claim 6,
wherein the evaluation and control circuit is configured first to allow a waiting interval and then a calibration interval to elapse for the activation of the alarm device before the evaluation and control circuit transitions into monitoring operation;
wherein the evaluation and control circuit is configured to detect a position of the folding lock by the accelerometer during the calibration interval and to store the position; and
wherein the evaluation and control circuit is configured to compare a current position detected by the accelerometer with the stored position several times during monitoring operation and to trigger the alarm signal when the comparison shows a predefined minimum deviation.

12. The folding lock in accordance with claim 11,
wherein the evaluation and control circuit is configured to deactivate the alarm device when the closing bar departs the second closing position.

13. The folding lock in accordance with claim 1,
wherein the lock body comprises a common housing for the latching mechanism and the alarm device, the common housing having a first chamber for the latching mechanism and a second chamber separate from the first chamber for the alarm device.

14. The folding lock in accordance with claim 13,
wherein the common housing is formed as a single casting housing.

15. The folding lock in accordance with claim 13,
wherein the second chamber for the alarm device is arranged at a side of the first chamber remote from the jointed bar hoop.

16. The folding lock in accordance with claim 13,
wherein the first chamber is closed with the exception of a latching mechanism installation opening, a key introduction opening, an optional inlet opening for introducing the closing bar, an optional passage opening for passing the closing bar into the second chamber, and optional fixing openings for inserting fixing elements for fixing the latching mechanism;
wherein the latching mechanism can be inserted into the first chamber through the latching mechanism installation opening; and
wherein the closing bar at least partly blocks the latching mechanism installation opening when the closing bar adopts the first closing position or the second closing position.

17. The folding lock in accordance with claim 1,
wherein the lock body has a latch device that is configured to hold the closing bar in a force fit in at least one of the first closing position and the second closing position.

18. The folding lock in accordance with claim 17,
wherein the latch device comprises an elastic section of a housing or of a housing sleeve of the lock body that latchingly cooperates with a counter-section of the closing bar.

19. The folding lock in accordance with claim 1,
wherein the jointed bar hoop is foldable into a yardstick configuration in which the jointed bar and the closing bar extend in parallel with one another;
wherein the jointed bar hoop can be brought into the yardstick configuration when the closing bar adopts the first closing position and/or when the closing bar adopts an unlatched transport position; and wherein the jointed bar hoop cannot be brought into the yardstick configuration when the closing bar adopts the second closing position.

20. A folding lock comprising;
a lock body that includes a latching mechanism and an alarm device that outputs an alarm signal upon being activated;

a jointed bar hoop that includes a plurality of jointed bars pivotably connected to one another, the jointed bar hoop includes a first end and a free second end, the first end of the jointed bar hoop is permanently fastened to the lock body; and a closing bar that forms the free second end of the jointed bar hoop, the closing bar being latchable to the lock body by the latching mechanism in a first closing position and a second closing position, in the first closing position the alarm device is prevented from being activated, and in the second closing position the alarm device is permitted to be activated.

21. The folding lock in accordance with claim 20, wherein the jointed bar hoop is foldable into a yardstick configuration in which the jointed bars extend in parallel with one another;

wherein the jointed bar hoop can be brought into the yardstick configuration when the closing bar adopts the first closing position; and wherein the jointed bar hoop cannot be brought into the yardstick configuration when the closing bar adopts the second closing position.

22. The folding lock in accordance with claim 20, wherein the jointed bar hoop is foldable into a yardstick configuration in which the jointed bars extend in parallel with one another;

wherein the jointed bar hoop can be brought into the yardstick configuration when the closing bar adopts an unlatched transport position; and wherein the jointed bar hoop cannot be brought into the yardstick configuration when the closing bar adopts the second closing position.

* * * * *